US006019051A

United States Patent [19]

Schairbaum

[11] Patent Number: 6,019,051

[45] **Date of Patent: *Feb. 1, 2000**

[54] LINER SLEEVE FOR MONITOR VIEWING APERTURE IN A WORK STATION

[75] Inventor: Edward C. Schairbaum, Ft. Worth, Tex.

[73] Assignee: Nova Solutions, Inc., Effingham, Ill.

[ * ] Notice: This patent is subject to a terminal disclaimer.

[21] Appl. No.: 09/063,757

[22] Filed: Apr. 21, 1998

Related U.S. Application Data

[63] Continuation of application No. 08/454,644, May 31, 1995, Pat. No. 5,740,743.

[51] Int. Cl.[7] ..... A47B 85/00

[52] U.S. Cl. ..... 108/25; 108/26

[58] Field of Search ..... 108/28, 26.2, 26, 108/161, 23, 24, 27, 50.01; 33/562; 248/917, 345.1

[56] References Cited

U.S. PATENT DOCUMENTS

| | | | |
|---|---|---|---|
| Re. 34,266 | 6/1993 | Schairbaum . | |
| 799,710 | 9/1905 | Brady | 108/26.2 |
| 1,114,922 | 10/1914 | Sengbusch | 108/26.2 |
| 1,938,964 | 12/1933 | Hogue | 108/26 X |
| 2,768,047 | 10/1956 | Strauss | 108/26 X |
| 2,935,209 | 5/1960 | Fritz | 108/25 |
| 3,364,882 | 1/1968 | Merrick | 108/25 |
| 3,540,130 | 11/1970 | French | 22/562 X |
| 4,590,866 | 5/1986 | Schairbaum . | |
| 4,755,009 | 7/1988 | Price et al. . | |
| 5,071,204 | 12/1991 | Price et al. . | |
| 5,087,010 | 2/1992 | Walters . | |
| 5,125,727 | 6/1992 | Lechman et al. . | |
| 5,290,099 | 3/1994 | Lechman . | |
| 5,408,939 | 4/1995 | Lechman . | |
| 5,740,743 | 4/1998 | Schairbaum | 108/25 |

FOREIGN PATENT DOCUMENTS

| | | | |
|---|---|---|---|
| 1106895 | 8/1981 | Canada . | |
| 1179280 | 5/1959 | France | 108/26.2 |
| 960682 | 3/1957 | Germany | 108/25 |

*Primary Examiner*—Jose V. Chen
*Attorney, Agent, or Firm*—Olson & Hierl, Ltd.

[57] ABSTRACT

Apparatus and method are provided for preparing a viewing aperture in the top deck of a work station. The aperture when formed is provided with a liner sleeve adjacent to its perimeter. The outside face of the liner sleeve engages the edge wall of the aperture and the inside face of the liner sleeve supports rim portions of a transparent panel that is inset across the aperture. Various cross-sectional profiles for the aperture edge wall and the opposing faces of the liner sleeve can be used. The invention provides a reliable procedure for making an accurately sized aperture for monitor viewing in a deck.

13 Claims, 3 Drawing Sheets

LINER SLEEVE FOR MONITOR VIEWING APERTURE IN A WORK STATION

This is a continuation of application Ser. No. 08/454,644, filed May 31, 1995, U.S. Pat. No. 5,740,743.

FIELD OF THE INVENTION

This invention relates to apparatus and methods for uniformly preparing a monitor viewing aperture in the top surface of a work station, the aperture when formed being fitted with a liner sleeve which engages edge portions a transparent panel member.

BACKGROUND OF THE INVENTION

Work stations, in the form of desks, tables, modules, and the like, that have a monitor located under an aperture or window in their top working surface are known; see, for example, Schairbaum U.S. Reissue Pat. No. Re. 34,266 or Lechman et al. U.S. Pat. No. 5,125,727.

Although such work station structures are coming into wide usage, one problem that is associated with their construction is the preparation of the monitor viewing aperture, particularly in a top surface that is comprised of wood or wood-containing materials, such as wood, plywood, laminated chip board, or the like. Each aperture needs to be accurately formed.

Conventionally, the usual aperture is not only provided with perimeter dimensions which closely accommodate an inset transparent panel comprised of glass or plastic, but also is provided along its edge wall with an inwardly extending lower ledge or flange which supports the panel so that the upper face thereof is flush with the top surface of the work station. Thus, precision is required when cutting out the aperture with a power saw, router, or the like. If the desired cutter path through the top surface is not maintained, the work station can be quickly ruined.

After an aperture is thus cut, its perimeter edge wall almost always has a color which does not match that of the top surface of the work station or which is undesirably eye-catching when a user is looking through an inset transparent panel to view a monitor screen positioned beneath. To eliminate such an undesirable edge wall coloration, it is conventional to paint or stain the edge wall before the transparent panel is inset into the aperture. Such a painting or staining must be done with care to achieve uniformity and to avoid showing upon adjacent top surface portions of the work station.

This conventional procedure for aperture formation, preparation, and plate insertion and positioning is not only time and labor consuming, but also is inevitably risky particularly because of the difficulty of achieving the exact aperture size. Not uncommonly, a filler must be packed into a gap existing between the rim edge of a transparent panel and an adjacent portion of the aperture edge wall in an effort to hide the gap and produce a smooth surface region between the panel and the top surface.

The art needs a new and improved aperture forming procedure and product apertured surface which overcomes such problems and disadvantages. The present invention achieves these objectives.

SUMMARY OF THE INVENTION

This invention relates in one aspect to a new and improved method for uniformly forming an aperture in the top surface of a work station.

The invention also relates in another aspect to new and improved apparatus useful in the practice of this aperture forming method.

The invention further relates in still another aspect to a new class of liner sleeves whose members have inside and outside generally transversely spaced respective side surfaces. The outside surface is positionable against the aperture edge wall. The inside surface is configured to support the rim region of a transparent panel that is inset into the aperture that is lined with such a liner sleeve.

Preferably, the aperture is formed using the forming method and apparatus of the invention, and preferably the aperture as so formed in the top surface of the work station has an edge wall which extends vertically or diagonally inwards (relative to the aperture in the top surface) in a straight direction through the thickness of the top surface (when viewed in vertical section). However, if desired, the aperture edge wall can be configured to include a flange, notch or other profile (when viewed in vertical section).

The liner sleeve outside surface is configured to mate with an aperture edge wall in a face-to-face engagement. Preferably, the height of a liner sleeve is such as to extend the full vertical height of an associated aperture edge wall.

Like the outside surface, the inside surface of the liner sleeve can have various configurations (when viewed in vertical section). Preferably, the inside surface is configured to include an inwardly projecting flange to provide a relatively short shelf-like surface upon which the bottom rim edge region of the transparent panel can rest with the panel being in its desired inset position (relative to the top surface). Preferably, the plate upper surface is flush with the top surface. However, the inside surface of the liner sleeve can be alternatively configured, if desired, to have various other desired profiles (when viewed in vertical section).

To form a viewing aperture in a top surface, the invention provides a new and very useful template assembly which includes a pair of cooperating sized (typically rectangular or square) frame members which extend from a deck side edge over opposed surfaces of a deck so as to be located respectively over and under the deck about the perimeter region of an aperture that is to be formed in the deck. The frame members are interengaged and aligned relative to one another by bracket means associating the adjacent outside frame edge portions that are adjacent the deck side edge.

In one template assembly embodiment, these frame members are associated with, and are supported by, the deck itself. In another embodiment, these frame members are associated with, and are supported by, a cooperating frame supporting structure that is also adapted to hold a deck and to concurrently position the frame members in their desired positions relative to the deck.

In forming an aperture in a deck member by the method of this invention, one first associates a deck which is to be apertured with one embodiment of the template assembly that is positioned in the region where the aperture is to be formed. Then, with the template assembly for guidance, the aperture is cut out from the deck preferably using an electric motor powered router and the cut out panel is removed. Thereafter, a selected liner sleeve is associated with the edge wall of the aperture and the panel is positioned in and across the aperture.

The invention avoids the need to paint or stain the aperture edge wall before inserting the transparent panel into and across the aperture since the liner sleeve that fits against the edge wall can be provided with a desired coloration preliminarily during its preparation.

The invention makes possible the accurate forming of panel-supporting aperture at a desired location in a deck in a simple and reliable manner.

The invention is suitable for practice at various scales of utilization. For example, it is adaptable for use in mass production of work stations, and, at an opposite extreme extent of practice use, it is also adaptable for use in converting an individual preformed desk or table for use with an internally angularly held, but externally viewable (through the transparent panel that is mounted in aperture), monitor.

Other and further objects, aims, features, purposes, advantages, embodiments, variations and the like will be apparent to those skilled in the art from the present specification taken with the accompanying drawings and the appended claims.

DETAILED DESCRIPTION

Figure 1:
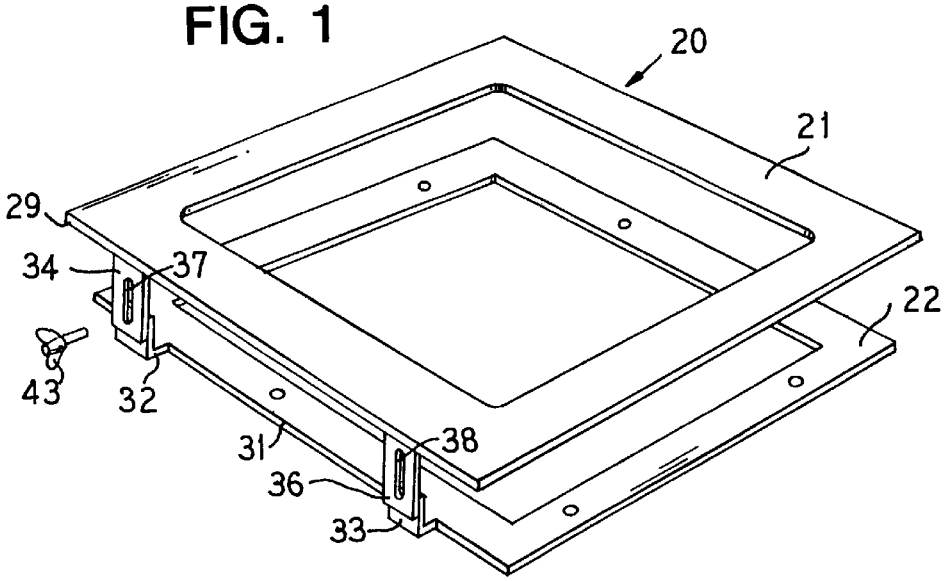
FIG. 1 is a perspective exploded view of one embodiment of template apparatus of the present invention which is adapted for utilization in the practice of the present invention.
Figure 2:
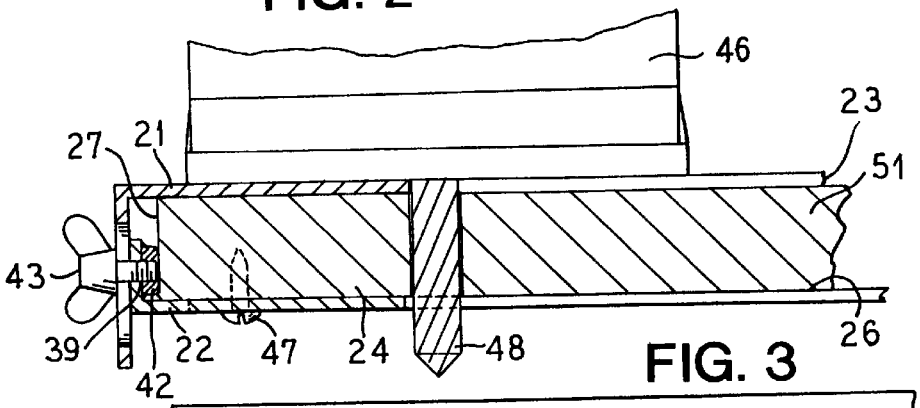
FIG. 2 is a transverse vertical sectional view through a work station deck with the template apparatus of FIG. 1 engaged therewith and also with a router that is in cooperative and operative association therewith.
Figure 3:
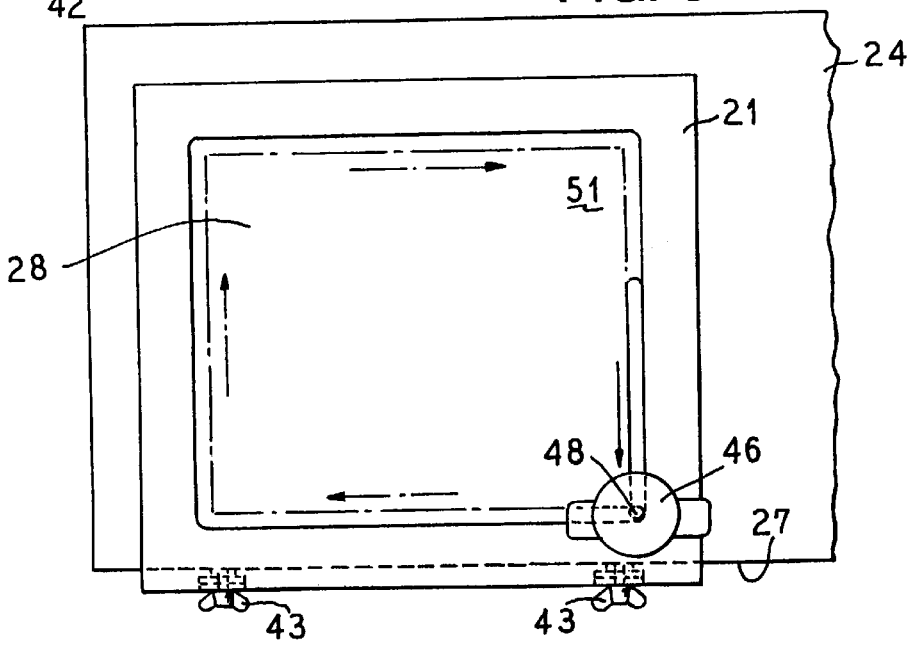
FIG. 3 is a top plan view of the assembly shown in FIG. 2.

Referring to FIGS. 1–3, there is seen one embodiment 20 of a template assembly of this invention. Template assembly embodiment 20 includes a pair of sized frames 21 and 22. The frame size is preferably somewhat rectangular as regards to the area defined thereby. However, any convenient or desired aperture-defining sizes can be associated with the respective frames 21 and 22 as described herein including trapezoidal, hexagonal, circular oval or the like. The frame 21 is adapted to be positioned in adjacent relationship over the upper face 23 of a deck member 24 of a work station (not shown in FIGS. 1–3 but see illustrative FIG. 7). The frame 22 is adapted to be positioned in adjacent relationship to the frame 21, but frame 22 is located below and adjacent to the lower face 26 of the deck member 24.

The frame members 21 and 22 extend from a deck member 24 side edge 27 inwardly and laterally across the deck member 24 so as to be located over and under, respectively, the deck member 24, and also so as to be positioned about the perimeter region of an aperture 28 (see FIG. 3) that is to be formed in the deck member 24.

To maintain an aligned relationship between frame 21 and 22 so that the aperture defined by frame 21 is centered over the aperture defined by the frame 22, the adjacent outside edges 29 and 31 of, respectively, frames 21 and 22 are each provided with slidably interconnecting cooperating pairs of bracket members, identified as bottom brackets 32 and 33 and top brackets 34 and 36. The bottom brackets 32 and 33 extend from and perpendicularly upstand from outside edge 31 of frame 22, and the top brackets 34 and 36 extend from and perpendicularly down turn from outside edge 29 of frame 21. The terminal region of each one of the bottom brackets 32 and 33 is located so as to be in adjacent, vertically slidable relationship to a different one of each of the terminal regions of top brackets 34 and 36. The terminal region of each top bracket 34 and 36 is elongated and provided with a central, vertically extending, slotted aperture 37 and 38, respectively. Each bottom bracket 32 and 33 is provided in its terminal region with a central hole 39 (see FIG. 2). One hole 39 is aligned with aperture 37 and the other hole 41 with aperture 38. The inside face (relative to deck member 24) of the terminal portion of each bottom bracket 34 and 36 is associated by welding or the like (not shown) with a nut 42 so that a wing headed bolt 43 or the like is extendable through each one of the aligned combinations of aperture 38/hole 39 and aperture 37/hole 39 and is threadably engagable with the associated nut 37. Thus, the vertical spacing between frame 21 and frame 22 is adjustable by means of the clamping action provided by the manual adjustment of tension on each bolt 43, yet the frame 21 is maintained in the desired aligned relationship with the frame 22. Auxiliary wedge means (not shown) may be used, if desired, to support the inward side of frame 21 in spaced relationship to the adjacent upper face 23 of deck member 24. This adjustment vertical spacing is optional, but is desirable not only to accommodate different relative thicknesses of various deck members, but also to accommodate different possible spacings (or elevations) between the lower face of the upper frame 21 and the adjacent upper face 23 of a deck member 24. Such adjustability may be needed to permit the inside perimeter 44 of frame 21 to engage slidably with and to guide during cutting, a predetermined and suitable portion of a router assembly 46, or a router bit or blade 48, that is being used to cut out an aperture 28 in a deck member 24.

In use, the template assembly 20 is initially associated with a deck member 24 from one side edge 27 thereof with the frame 21 perimeter 44 being centered over the (future) aperture 28 of the frame 22. The perimeter 44 of the frame 21 is positioned to define the location of the aperture 28 to be formed in deck member 24. At this time, the frames 21 and 22 may be in contacting relationship with upper face 23 and the lower face 26, respectively, of deck member 24.

Once the exact location of the aperture 28 is decided upon, the bolts 43 can be preliminarily tightened to fix the relationship between frames 21 and 22 during the next engaging operation, if employed. Thus, the lower frame 22 is preferably engaged with the lower face 26 of deck 24. Such engagement is conveniently achieved by means of a plurality of screws 47 which are extended through holes 52 defined in the frame 22 and into threaded engagement with the deck member 24. Then, the spacing between the upper frame 21 and the upper face 23 can be adjusted (for purposes of router 46 guidance) by loosening the bolts 43 followed by retightening. As those skilled in the art will appreciate, the dimensions of the frame 22 aperture and its associated inside perimeter are made slightly larger than corresponding respective dimensions in the upper frame 21 in order to avoid interference of frame 22 with the blade 48 of the operating router assembly 46 as the blade 48 cuts out the aperture 28.

Although other cutting apparatus can be used, as those skilled in the art will appreciate, it is preferred to employ a router, such as router assembly 46, which is functionally guidable by the perimeter 44 of upper frame 21 because of the ease of use. A single router blade 48 can be used to penetrate the deck initially, and then, tracking along the frame 21 perimeter 44, cut out the aperture 28. The circumferential cutting edge of a router blade 48 can produce various edge wall 49 contours about the perimeter of the aperture 28 in deck 24. The corner regions of the aperture 28 have a rounded contour in horizontal section. The minimum radius of a corner contour is determined by the diameter of the router blade 48. After the perimeter of the aperture 28 is completely cut, the resulting panel 51 that has been thus cut away from the deck member 24 is separated. Although more than one complete cutting cycle or path about perimeter 44 can be employed for forming a given aperture 28 (where one complete cutting cycle is a complete passage of one operating router means about the perimeter 44 of the upper frame 21), it is now preferred to accomplish the aperture 28 formation in a single cycle as distinct from two or more such cycles, where, for example, in each cycle, a different router blade is utilized to produce a different profile (as seen in vertical section) in the edge wall 49. Once the panel 51 has been cut out and the edge wall 49 formed, the template assembly 20 is dissociated from the deck member 24. Thus, screws 47 are removed and template assembly 20 is slid away from deck member 24.

The template assembly 20 is adapted for use in preparing apertures in deck members that are already associated with, and remain associated with, other portions of a previously assembled work station (not shown) during aperture formation. Sometimes, however, it is not convenient or even possible to work at aperture formation in the deck that is associated with a pre-assembled work station. For such circumstances, the template assembly 20 is conveniently associated with a table-type supporting frame assembly 54 that is provided by the present invention. The frame assembly 54 is used in combination with a template assembly 20 and a separated deck member 24.

Frame assembly 54 incorporates four upright legs 56 which are associated together by medial end cross supports 57 (paired) and a medial back side cross support 58, and by top end cross supports 59 (paired) and top back side cross support 61. A top front side cross support 62 is provided by the combination of (a) a pair of longitudinally spaced, parallel bars 62A and 62B which terminate at the respective upper ends of the front legs 56 and which inwardly extend in opposed relationship, and (b) a central joining bar 62C which extends between the inner ends of bars 62A and 62B and overlaps upon the respective under surface end-adjacent portions thereof. A transverse brace bar 63 (paired) extends normally between the inner end of each bar 62A and 62B and the inside edge of the top back side cross support 61. All contacting ends and overlap regions are conveniently secured together by welding or the like (not detailed). Various alternative structural configurations for frame assembly 54 can be utilized, as those skilled in the art will appreciate, but the spacing between the opposed sides of bars 63, and also between the ends of supports 62A and 62B, is such as to accommodate the longitudinal width of lower frame 22 for the purposes below indicated. Preferably the width across the top of the frame assembly 54 is compatible with the lateral width of the frames 21 and 22.

Figure 4:
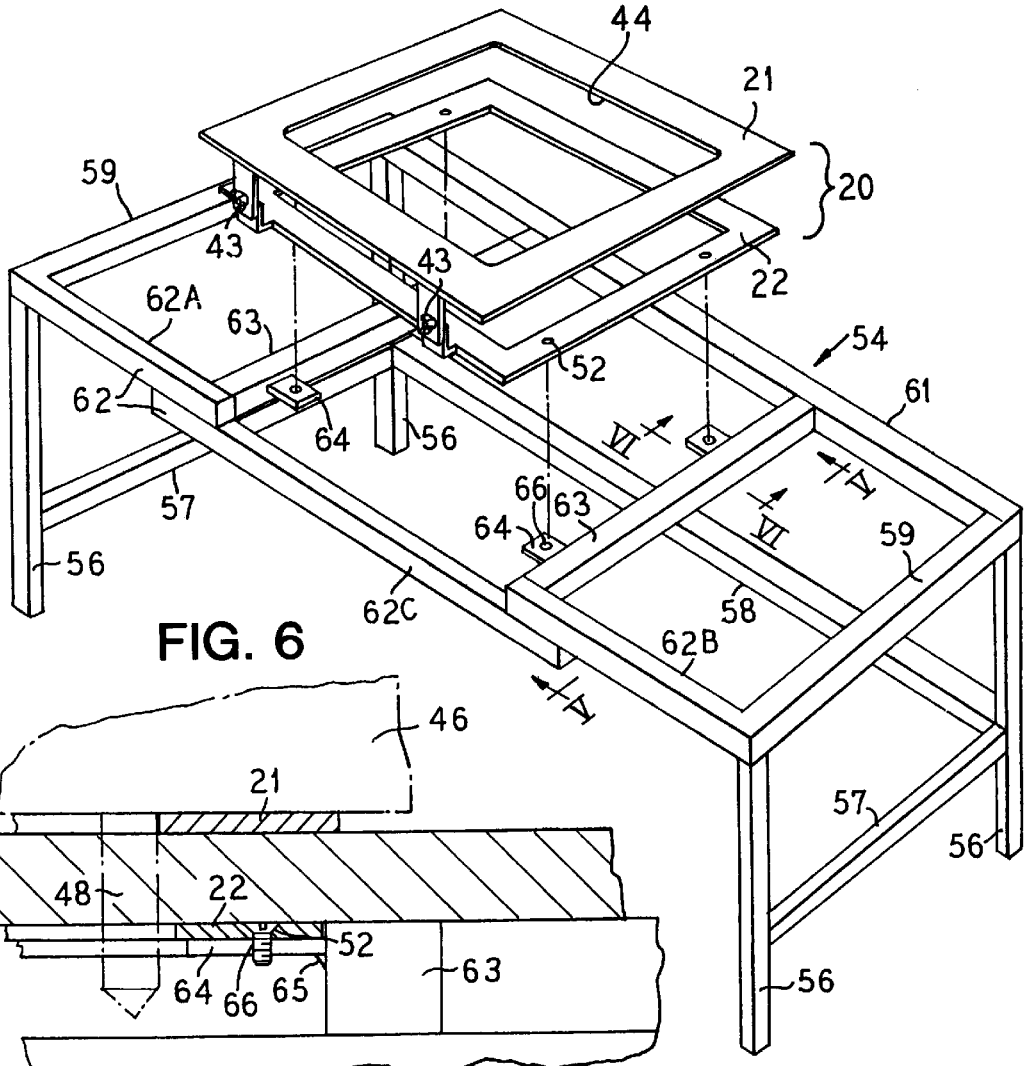
FIG. 4 is a perspective exploded view of an embodiment of an integrated assembly of template apparatus such as shown in FIGS. 1–3 with coacting supporting frame which is provided by the present invention and which is likewise adapted for utilization in the practice of the present invention.
Figure 6:
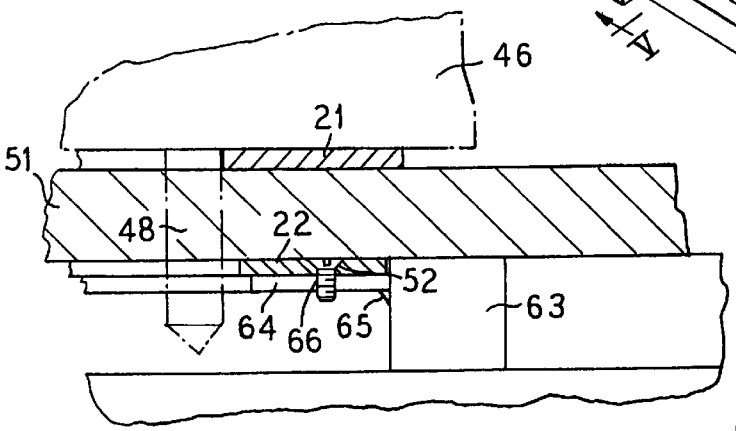
FIG. 6 is a fragmentary longitudinal view similar to FIG. 5, but taken generally along the line VI—VI of FIG. 4, and showing a router in cooperative and operative association with such assembly.
Figure 5:
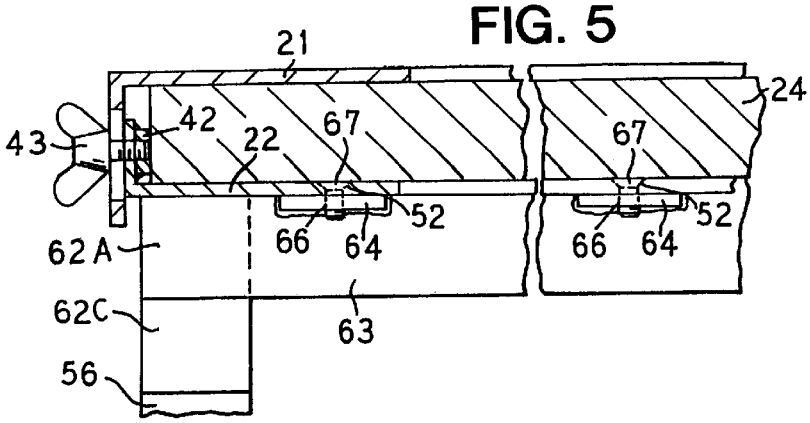
FIG. 5 is a fragmentary transverse vertical sectional view taken generally along the line V—V of FIG. 4 with the assembly being in further association with a deck member in which an aperture is to be formed.

The combination of top support 62, bars 62A and 62B, cross supports 59, and brace bars 63 defines a generally flat surface upon which a deck member, such as a deck member 24 or the like (not shown in FIG. 4 but see FIGS. 5 and 6), is restable in a generally horizontal orientation. A deck member 24 can be temporarily clamped against such flat surface by C-clamps or the like (not shown) in a fixed position. Preferably, the front side of the deck member 24 is flush with the front of the cross support 62 or is otherwise oriented so as to be in a desired parallel relationship with the cross support 62.

Preferably before the deck member 24 is thus associated with this flat surface, the lower frame 22 is nestably received between the opposing side edges of brace bars 63 and also is so located to be without interference from support 61. Preferably the inside edge of lower frame 22 is adjacent to the inside edge of the top back side cross support 61. The lower frame 22 is supported in this configuration by four support tabs 64 which inwardly extend in the relationship of two opposing pairs extending from opposing side edges of brace bars 63. The tabs 64 are fastened to the brace bars 63 by weldments 65 or the like. A medial, threaded, vertical bore 66 in each tab 64 is provided. Each tab 64 and bore 66 combination is so positioned that each bore 66 is aligned with a different respective hole 52 in opposing sides of the lower frame 22. Thus, a machine screw 67 or the like is receivable through each so aligned hole 52 into threaded engagement with an adjacent bore 66 so that the lower frame 22 is retainable by frame assembly 54 in fixed relationship relative to both the frame assembly 54 and also a deck member 24 that is associable with the frame assembly 54 as above described. Preferably and as shown, the screw heads of the screws 67 are circumferentially tapered adjacent their threaded shanks and the holes 52 are matingly counter sunk. Hence, when mutually interengaged, the heads of screws 67 are flush with the adjacent side surface portions of lower frame 22.

With the lower frame 22 thus fixed relative to the deck member 24 and the frame assembly 54, the upper frame 21 is associated with the lower frame 22 using the wing headed bolts 43 as described above. Frame 21 is positioned over the top surface of the deck member 24 at the location where the aperture 28 so that the inside perimeter 44 of upper frame 21 can be employed for guidance of the router assembly 46 as the aperture 28 is cut. The inner ends of the tabs 64 are formed so that they do not extend across or into the path of the router bit 48 as the panel 51 is cut out (see FIG. 6).

After the formation of the aperture 28 is complete, the deck member 24 is separated from the frame assembly 54 and the template assembly 20. The deck member 24 can be associated with the remaining components of a work station with which the deck member 24 is associatable.

Either before or after the deck member 24 with the formed aperture 28 therein is separated from the template assembly 20 (and the frame assembly 54, if such has been used) the aperture 28 is fitted or lined with a liner sleeve 69 of this invention. The liner sleeve 69, as is typical of the liner sleeves of this invention, is adopted for association with the edge wall 49 of aperture 28. The liner sleeve 69 is preferably a transversely flattened body which has an outside face 71 that is configured to associate in face-to-face engagement with the edge wall 49 and which has a generally opposed inside surface 72 that is configured to engage (when the liner sleeve 69 is associated with the edge wall 49) rim edge portions 74 of a substantially transparent panel member 73 that is positionable in and across the aperture 28. The liner sleeve 69 and the edge wall 49 cooperate to provide rim edge support of the panel 73.

The panel member 73 is conveniently comprised of glass (preferred), plastic, or the like. Conveniently and preferably, panel member 73 has a rim edge 74 that extends evenly and perpendicularly relative to the opposing preferably spaced, parallel flat faces 76 and 77 of panel member 73. However, if desired, the panel member 73 can be provided with various vertical cross-sectional configurations in its rim edge 74 which are adapted to matingly engage a correspondingly (mirror image) vertical cross-sectional configuration selected for a particular liner sleeve 69. Such a matable liner sleeve 69 can have an inside face 72 with various configurations (in vertical section).

Figure 7:
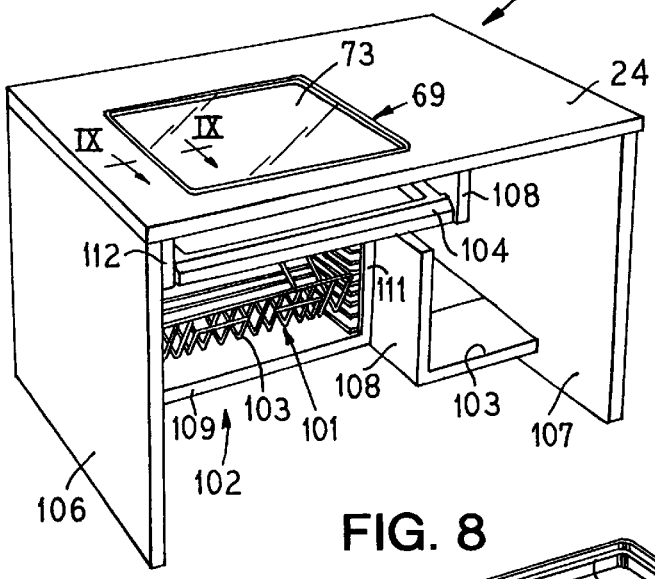
FIG. 7 is a perspective view of one embodiment of a work station structure whose deck has been processed with the apparatus of either FIGS. 1–3 or of FIGS. 3–6 so as to produce in the deck a rectangularly configured aperture and which aperture has then been fitted with one embodiment of a liner sleeve of the present invention and associated with a transparent panel.
Figure 9A:
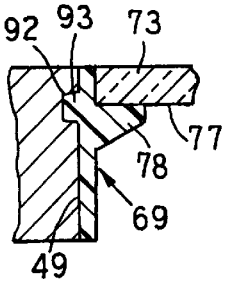
FIGS. 9A–9I are each a fragmentary longitudinal vertical sectional view taken through the region IX—IX of FIG. 7 with each one of the FIGS. 9A–9I showing a different illustrative embodiment of a combination of apertured deck, liner sleeve, and transparent panel as provided by this invention.
Figure 8:
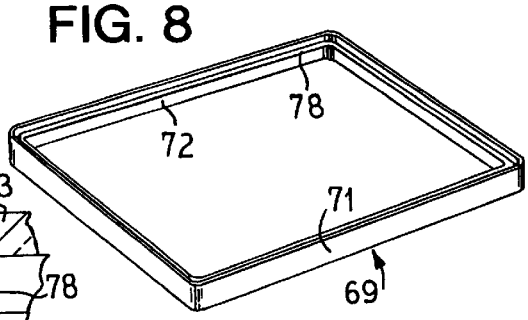
FIG. 8 is a perspective view of the liner sleeve shown in the combination of FIG. 7.
Figure 9B:
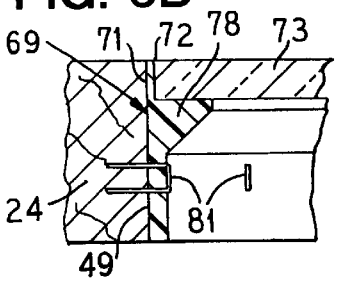

An illustrative cross-section configuration is shown in FIG. 9B which corresponds to the liner sleeve of FIG. 8 and the combination of FIG. 7. The interrelationship between the deck member 24, the edge wall 49, and the liner sleeve 69 is such that the panel member 73 is supportable in the aperture 28 preferably with the panel member 73 being inset into the aperture 28 with its upper rim adjacent face 76 being flush (i.e. even) with the aperture adjacent upper face 23 of deck member 24 and with the deck member 24 being horizontally oriented.

The liner sleeve, such as liner sleeve 69, is preferably comprised of a plastic material which is initially thermoplastic and which may be after forming cross-linkable. Alternatively, the liner sleeve 69 may be comprised of wood (such as wood, wood veneer, wood fibers dispersed in a flexible plastic binder or the like), metal (such as aluminum, steel, copper, alloy thereof, or the like), or inorganic substance (such as ceramic, stone or synthetic stone of marble, soapstone or the like). The liner sleeve can be a composite structure, for example, a plastic body with a wood veneer along at least one of its two opposite side edges.

A liner sleeve, such as liner sleeve 69, can be formed by various procedures and is comprised of a shape-retaining resilient plastic (preferred) or metal. One presently preferred formation procedure is to form a liner sleeve as a single closed loop of molded plastic, such as is accomplishable by injection molding or the like when a thermoplastic. Another suitable and convenient formation procedure is to form the liner sleeve as a continuously extruded profile comprised of a molded plastic aluminum, or the like. Suitable plastics include thermoplastics based on polymers in the olefin family, the acrylate family, the vinyl family, copolymers and the like. For a given prechosen aperture, the length of a given profile for a given liner sleeve corresponds to the perimeter of the edge wall of the aperture 28. In an assembled combination, opposite ends of such a profile abut at a location along the perimeter of aperture 28.

One presently preferred liner sleeve type, such as illustrated by liner sleeve 69, has an outside face 71 which (as shown in FIGS. 8 and 9B) is smooth (i.e., extends in vertical section continuously without a projection or a recess), and an inside face 72 which includes an integral, inwardly projecting, perimetrically extending flange 78 that is configured and adapted to engage rim adjacent bottom surface portions 77 of the panel member 73. If desired, either the edge wall 49 can be adhesively bonded to the outside face 71 of the liner sleeve 69, or the outside face 71 can be retained in association with the edge wall 49 with mechanical fastening means, such as nails, staples, brads, tacks, counter sinkable screws and the like, which penetrate a liner sleeve 69 and then an edge wall 49 before entering deck 24 and which are located and positioned so as not to interfere with the association of the panel member 73 with the liner sleeve 69 when the panel member 73 is positioned in and across the aperture 28. In some configurations, such as herein exemplified and described, no such auxiliary retaining means is needed to retain a liner sleeve in functional and operative association with a deck (or with a panel member).

The appearance of a deck member 24 which has an aperture 24 whose edge wall 49 has been fitted with a liner sleeve 69 and which has then been associated with a panel member 73 is illustrated in the environmental perspective view of FIG. 7. Here, the deck member 24 is illustratively associated with other components of a work station 79. The appearance in vertical section of the liner sleeve 69 in combination with the deck 24 and the panel member 73 is illustrated in FIG. 9B. The outside face 71 of the liner sleeve 69 is here fastened against the edge wall 49 by means of a plurality of staples 81 that are driven through the inside face 72 by impact means, such as a power-driven conventional stapling gun (not shown) or the like. The staples 81 are located below the flange 78 in liner sleeve 69 to avoid interference with the panel 73. Thereafter, the panel 73 is mounted in the aperture 28 optionally with the use of a suitable adhesive or sealant.

Referring to FIG. 7, it is seen that the work station 79 has a desk-like configuration. The inset panel 73 is useful as a window for viewing through the aperture 28 in the deck member 24. Panel 73 is here offset to one side of the deck member 24, but those skilled in the art will appreciate that an inset viewing window or panel 73 can be achieved by the practice of this invention at any desired location in a deck member. In the work station 79, a computer monitor support assembly 101 is mounted in the knee cavity 102 of the work station 79 below the inset panel 73. The monitor support assembly 101 can have many different configurations. An illustrative form of such an assembly is taught by the aforereferenced Lechman et al. U.S. Pat. No. 5,205,631, for example. The computer monitor (not shown) is functionally associatable with a computer (or c.p.u., not shown) that is housed in the work station 79 on shelf 103.

To operate the computer, a keyboard (not shown) is positionable on a slidably extensible and retractable (relative to the front or user side of the work station 79) tray 104. Tray 104 is located adjacently beneath the deck member 24 and also adjacent to the panel 73 over the knee cavity 102. The tray 104 can have various structures. An illustrative structure is taught by Wegman et al. U.S. Pat. No. 5,205,651. Thus, an operator (not shown) can sit at the work station 79 (chair not shown) and operate the keyboard while observing the monitor through the panel 73.

The deck member 24 is supported in spaced, horizontally-oriented relationship to a floor by a pair of laterally elongated end walls 106 and 107 and a partial back wall (not shown) extending therebetween. Defining the right side of the knee cavity 102 is a vertical internal wall or partition 108 which is supported by the deck 24 and the back wall. On the bottom side of wall 108 the shelf 103 is connected. The opposite side of shelf 103 is supported by end wall 107. The opposed side of wall 108 supports both a longitudinal cross brace 109 that extends between wall 108 and end wall 107 and a vertical brace 111 which associates with the monitor support assembly 101. Also, the tray 104 is supported between wall 108 and a support member 112 that horizontally extends across the inside upper surface of end wall 106.

The work station 79 and its associated component structural elements are here illustratively formed of a conventional laminated chip board wherein the surface laminate is a melamine-formaldehyde sheet or the like. Any convenient structural material can be employed in a work station 79 including formed sheet metal, as those skilled in the art will appreciate. A deck of sheet metal, or a combination of sheet metal and plastic, can have an aperture formed therein by the apparatus and methods of this invention, and can be fitted with a liner sleeve and a transparent panel as taught herein.

Shown in FIGS. 9A through 9I are various alternative combinations of embodiments and component configurations for the adjoining surface portions between the combination of the side wall 49 of aperture 28, the panel 73 and the liner sleeve 69 (such component designation numerals here being employed in a generic sense for convenient present identification and description purposes. In each of the combinations shown in FIGS. 9B, 9C, 9D, 9E, 9G and 9H and 9I, the side wall 49 is smooth sided and extends vertically and uninterruptedly through the deck member 24 (in vertical section).

Figure 9C:
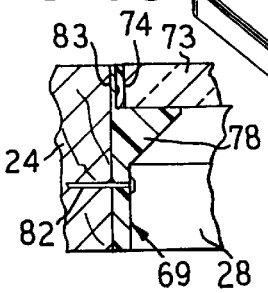

The combination shown in FIG. 9C is similar to that shown in FIG. 9B except that here brads 82 instead of staples are used to fasten the liner sleeve to the side wall 49. Also, in the FIG. 9C combination, the embodiment of the liner sleeve 69 is provided during its formation with a laterally-compressible, continuously elongated, elastomeric, blister-type cushion 83 that is located in the region above the flange 78 opposite the location where the rim 74 of panel 73 is positioned in the assembled combination.

The cushion 83 is adapted to be compressed somewhat by the rim 74 when the panel 73 is in its associated position so that the panel 73 is yieldingly laterally biased towards a centralized position (relative to the aperture 28). Also, the cushion 83 acts as a seal which prevents or retards entrance of undesirable dust and small particles into the intermediate space that might otherwise exist between the rim 74 and the liner above 69.

Figure 9F:
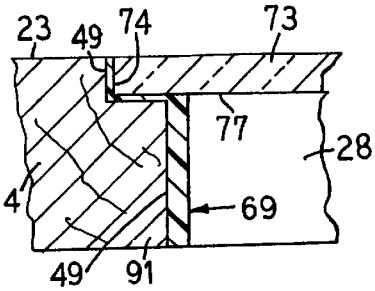
Figure 9D:
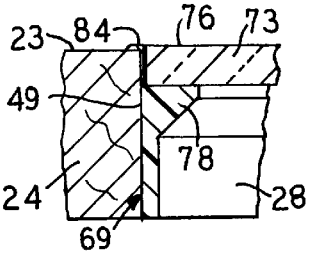

The embodiment combination shown in FIG. 9D is similar to that shown in FIG. 9B except that here the upper edge of the liner sleeve 69 is formed with a small outturned integral top flange 84 that has a relatively rigid nature. The flange 84 thus aids in holding the associated integrally formed liner flange 69 in a fixed position relative to the edge wall 49 when downwardly exerted pressure or weight is placed upon the upper face 76 of panel 73. If desired, the top edge of the upper face 23 adjacent the aperture 28 can be routed (not shown) to an extent sufficient to receive the flange 84. This liner sleeve 69 can be adhesively bonded to contacting portions of the deck member 24, or not, as desired.

Figure 9E:
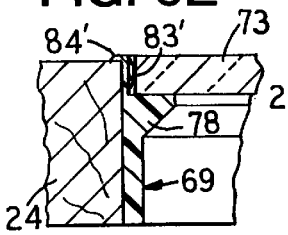

The combination shown in FIG. 9E is similar to the combinations shown in each of FIGS. 9C and 9D, but, in the FIG. 9E combination, the liner sleeve 69 incorporates both a cushion 83' (analogous to the cushion 83) and a top flange 84' (analogous to flange 84).

Figure 9I:
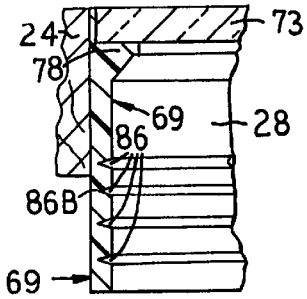
Figure 9G:
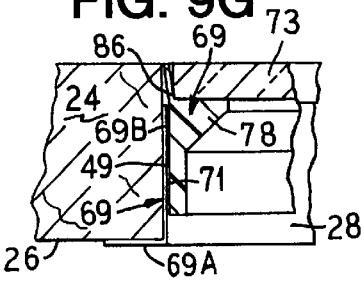

The combination shown in FIG. 9G employs a liner sleeve assembly 69 that utilizes an initially separate lower piece 69A that coacts therewith. The lower piece 69 is L-configured in vertical cross-section. The bottom leg 69A of the L is mounted so as to outwardly extend away from the aperture 28 yet is flat against the lower face 26 of the deck member 24 adjacent the edge wall 49. The upright leg 69B of the L is mounted so as to be in adjacent contacting relationship with the edge wall 49. These legs 69A and 69B of lower piece 69 are secured to the lower face 26 and to the edge wall 49 by conventional adhesive means or mechanical means (such as above indicated) or both.

The liner sleeve 69 has an outer surface 71 whose lower portion overlaps upon the inner surface of the leg 69B of the lower piece 69 (relative to the aperture 28). The inner surface 72 of liner sleeve 69B is provided with a integral flange 78 that is adapted to support the panel 73 on its lower face 77 adjacent rim 74. When the panel 73 is so supported and extends across aperture 28, the liner sleeve 69 in the region thereof above flange 78 is, in effect, cammed outwardly so that it is angled from its region 86 that joins at flange 78. Thus, its upper end is vertically located over the upright leg 69B of the lower piece 69. In addition to being mechanically or adhesively fastened to edge wall 49 (fastening means not shown), the liner sleeve 69 is retained against downward movement by the blocking action offered by the engagement achieved between the upper leg 69B of lower piece 69 in the region of the liner sleeve 69 that is above flange 78.

Figure 9H:
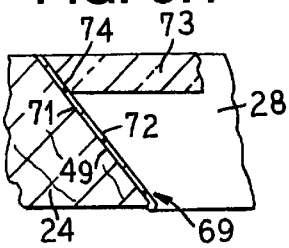

If desired, in the FIG. 9H embodiment, the outside face 71 of the liner sleeve 69 can be transversely thickened (not shown) commencing approximately at the level of the shelf surface of the flange 78, thereby to provide a shoulder at this level which is adapted to rest against the top edge of the lower piece 89B.

The combination shown in FIG. 9H utilizes a beveled edge wall 49 that is inwardly inclined relative to aperture 28. A mating panel 73 is provided with a rim edge 74 which is matingly conversely beveled at a reciprocal angle relative to this edge wall 49. The liner sleeve 69 has spaced, parallel surfaces 71 and 72 and has a width that is generally equal to the width of the beveled edge wall 49. Preferably, the liner sleeve 69 is fastened either mechanically or with adhesive (or both) to the edge wall 49. The panel 73 is then inset into the aperture 28. The inclined surfaces of edge 74 liner sleeve 69 and edge wall 49 cooperatively interengage and support the panel 73.

The combination shown in FIG. 9I is adapted for use with deck members 24 which are effectively thickened, such as for an aesthetic effect or otherwise, relative to the typical or average deck thicknesses (such as are common in deck members comprised of wood, chip board, or the like). For utilization with various deck members of different thicknesses, the liner sleeve 69 is here initially provided with an extended width. The inside face 72 of this liner sleeve 69 is provided with a panel support flange 78, and, therebelow, with a series of vertically spaced notches or grooves 86 formed in the liner sleeve 69 which extend in parallel relationship to each other and to the flat support surface of the flange 78. To use this liner sleeve 69, one approximately matches the thickness of the given deck member 24 in the region of the aperture 28 with the width of the liner sleeve 69 as measured from its upper edge (adjacent to the upper face 23 of the deck member 24) to the nearest (relative to the thickness) one notch, illustratively notch 86B. Then, one runs a cutting edge, such as a knife, a razor blade, or the like, around in that notch 86B to cut transversely through the liner sleeve 69 at that location. The resulting transversely shortened liner sleeve 69 is then associated with the edge wall 49 (as above described) and the panel 73 is next into the aperture 28.

In the respective combinations shown in FIGS. 9A and 9F, examples are presented of apertures 28 whose respective edge walls 49 are not straight when viewed in vertical section.

In the embodiment shown in FIG. 9F, the edge wall 49 is provided with a lower, inwardly extending flange 91 which is achieved, for example, by making two separate circumnavigations (or passes) of the inside perimeter of the upper frame 21 with a router, each pass being accomplished with a different blade. The flange 91 has an upper platform surface upon which the load of the panel 73 is borne. The lateral spacing between the rim edge 74 of panel 73 and the edge-wall 49, and the vertical spacing between the rim-adjacent lower face 77 of panel 73 and the platform surface of the flange 91, are made sufficient to accommodate the liner sleeve 69 and still achieve a flush relationship between the upper face 76 of panel 73 and the upper face 23 of deck member 24 in the assembled combination. The slightly resilient character of the liner sleeve 69 is useful for absorbing slight, localized dimensional variations between panel 73 and aperture 28. Also, the liner sleeve 69, as pointed out above, can be given a desirable coloration that is neutral and/or non-interfering with monitor screen viewability through the panel 73.

In the embodiment shown in FIG. 9A, the edge wall 49 is provided with a groove or uniform depression 92 that extends about its perimeter is spaced, parallel relationship to the adjacent edge of upper face 23 of deck member 24. Groove 92 can be conveniently cut concurrently with the edge wall 49 in a single pass of a suitably configured operating router blade (using the template assembly 20). A present preference is for the groove 92 to be positioned so as to overlap upon the (projected) location of the lower face 77 of the panel member 73. Such a positioning causes a desirable interlocking relationship to be produced in the assembled combination of deck 24, liner sleeve 69, and panel 73. Thus, the panel 73 as it rests upon flange 78 retains the integrally formed projection 93 on the outside face 71 of liner sleeve 69 in mating engagement with the groove 92. The result is that the liner sleeve 69 under the combined loads of panel 73 and variable weights thereupon cannot move downwards yet the liner sleeve 69 is stable and somewhat shock absorbing owing to its resiliency. No adhesive or mechanical fastening means is needed for mounting the combination together but is preferred.

Those skilled in the art will readily appreciate from the foregoing description that many variations and alterations are possible particularly in the liner sleeve, in the interrelationship between the mating combinations of apertured deck, liner sleeve, and panel, and in the particular design and construction of particular embodiments of the template assembly, without departing from the spirit and scope of this invention.

What is claimed is:

1. As an article of manufacture, a liner sleeve for interposition between edge wall portions that define the inside perimeter of an aperture existing in a deck member, and rim portions that define the outside perimeter of a cooperating panel member that is positioned in and across said aperture, said liner sleeve comprising:

a transversely generally flattened, elongated preformed supporting means for supporting said panel member, said supporting means having laterally spaced, generally opposed outside and inside surface portions;

said outside surface portions configured for overlining, extending along and associating in face-to-face adjacent engagement with said edge wall portions; and said inside surface portions configured for overlining, extending along and associating in face-to-face adjacent engagement with said rim portions;

whereby said liner sleeve, when so engaged with said edge wall portions and with said rim portions, is interposed in adjacent, mutually contacting relationship between said edge wall portions and said rim portions and supports said panel member in said aperture.

2. The liner sleeve of claim 1 which is comprised of a molded plastic.

3. The liner sleeve of claim 1 which is comprised of a metal.

4. The liner sleeve of claim 1 which is comprised of wood.

5. The liner sleeve of claim 1 wherein said outside surface portions are smooth.

6. The liner sleeve of claim 1 wherein said outside surface portions are an outwardly projecting flange means.

7. The liner sleeve of claim 1 wherein said inside surface portions include and inwardly projecting flange means that is adapted to engage bottom surface-adjacent regions of said rim portions.

8. The liner sleeve of claim 1 wherein said inside surface portions include an elastomeric region that is adapted to yieldingly engage said rim portions.

9. A method for forming an aperture in a deck member comprising the steps of:

(a) extending a template assembly from a side edge of said deck member adjacently over upper and lower faces of said deck member in the region thereof wherein said aperture is to be formed, said template assembly including a pair of sized frames one of which extends over, the other of which extends under, said deck, each said frame being in a predetermined oriented relationship relative to the other and at least one of said frames having an interior perimeter defined therein that outlines said aperture;

(b) cutting said aperture in said deck by cutting said deck around said perimeter thereby to produce said aperture in said deck, said aperture having an aperture perimeter that is defined by aperture edge wall portions; and (c) associating said edge wall portions in face-to-face engagement with inside surface portions of a liner sleeve as defined in claim 1.

10. The liner sleeve of claim 1 which additionally includes retaining means for mounting said liner sleeve to said edge wall portions.

11. The liner sleeve of claim 10 wherein said retaining means comprises an adhesive.

12. The liner sleeve of claim 10 wherein said retaining means comprises mechanical fastening means.

13. The liner sleeve of claim 1 whose said supporting means is in the form of a continuous elongated loop.

* * * * *